US007988211B2

(12) United States Patent
Anderson

(10) Patent No.: US 7,988,211 B2
(45) Date of Patent: Aug. 2, 2011

(54) AUTOMATIC-LOCKING-DEVICE

(75) Inventor: Roderick Duncan Anderson, Port Moody (CA)

(73) Assignee: Roderick Duncan Anderson, Port Moody, British Columbia ( * ) Notice: Subject to any disclaimer, the term of this patent is extended or adjusted under 35 U.S.C. 154(b) by 594 days.

(21) Appl. No.: 11/783,914

(22) Filed: Apr. 13, 2007

(65) Prior Publication Data

US 2007/0262587 A1 Nov. 15, 2007

Related U.S. Application Data

(60) Provisional application No. 60/745,266, filed on Apr. 20, 2006.

(51) Int. Cl.
*E05B 15/02* (2006.01)
*E05C 19/06* (2006.01)

(52) U.S. Cl. ..... 292/340; 292/1; 292/80; 292/DIG. 61; 220/1.5; 220/324; 211/194

(58) Field of Classification Search ..... 292/1, 23, 292/80–91, DIG. 61; 211/194; 220/1.5, 220/324
See application file for complete search history.

(56) References Cited

U.S. PATENT DOCUMENTS

| | | | | | |
|---|---|---|---|---|---|
| 398,439 | A * | 2/1889 | Parsons | 292/91 |
| 409,194 | A * | 8/1889 | Hardy | 292/91 |
| 531,116 | A * | 12/1894 | Hamshaw | 292/78 |
| 2,998,156 | A * | 8/1961 | Stricker, Jr. | 220/1.5 |
| 3,015,407 | A * | 1/1962 | Fesmire et al. | 220/1.5 |
| 3,478,919 | A * | 11/1969 | Turpen | 220/324 |
| 3,514,005 | A * | 5/1970 | Irwin | 220/1.5 |
| 3,797,691 | A * | 3/1974 | Williams, Jr. | 220/1.5 |
| 3,980,185 | A * | 9/1976 | Cain | 206/509 |
| 5,163,726 | A * | 11/1992 | Boos et al. | 294/81.1 |
| 5,462,188 | A * | 10/1995 | Yurgevich | 220/1.5 |
| 5,975,593 | A * | 11/1999 | Cress | 292/86 |
| 7,491,024 | B2 * | 2/2009 | Heinrichs et al. | 410/32 |

* cited by examiner

*Primary Examiner* — Carlos Lugo

(57) ABSTRACT

An improved integrated interbox connector to permit vertical stacking of cargo containers using no manual labor and includes an automatic pivoting engagement lock, a latch, a lip/end stop. The connecting corner can be retrofitted to existing containers by welding or the like.

1 Claim, 2 Drawing Sheets

AUTOMATIC-LOCKING-DEVICE

BACKGROUND OF THE INVENTION

The present invention relates to cargo containers suitable for use in multi-mode transportation of freight or cargo by ship, rail or overland truck.

This present invention avoids any intrusion into enclosed cargo container while at the same time permitting the container to be stacked more efficiently.

These corner fittings also allow multiple containers to be moved at the same time.

BRIEF SUMMARY OF THE INVENTION

The present invention relates to cargo containers suitable for use in multi-mode transportation of freight or cargo by ship, rail or overland truck.

The objects of the invention are to provide a fully automated container locking system using no manual labour to effectively lock and unlock vertically stacked containers with respect to each other to provide such container locking system where the component parts are integrated with the top corners of the containers, to provide a container locking system which is adapted for use with standard bottom corner fittings and without interfering with standard interbox connecting lugs and also embodying the world standard corner fittings for containers with said improvement.

Other features and advantages of the present invention will become apparent to those skilled in the art upon consideration of the following detailed description of the preferred embodiment exemplifying the best mode of carrying out the invention as presently perceived.

The detailed description particularly refers to the accompanying figures.

DETAILED DESCRIPTION OF THE INVENTION

The Automatic Locking Device 2, is attached to the top corners of a standard cargo container 7. When another standard cargo container 7 is placed on container, containers will become locked together. The manual labour component is removed from the process.

The device 2 is made of steel and can be welded to existing container corners 4 or used on new containers.

Figure 1:
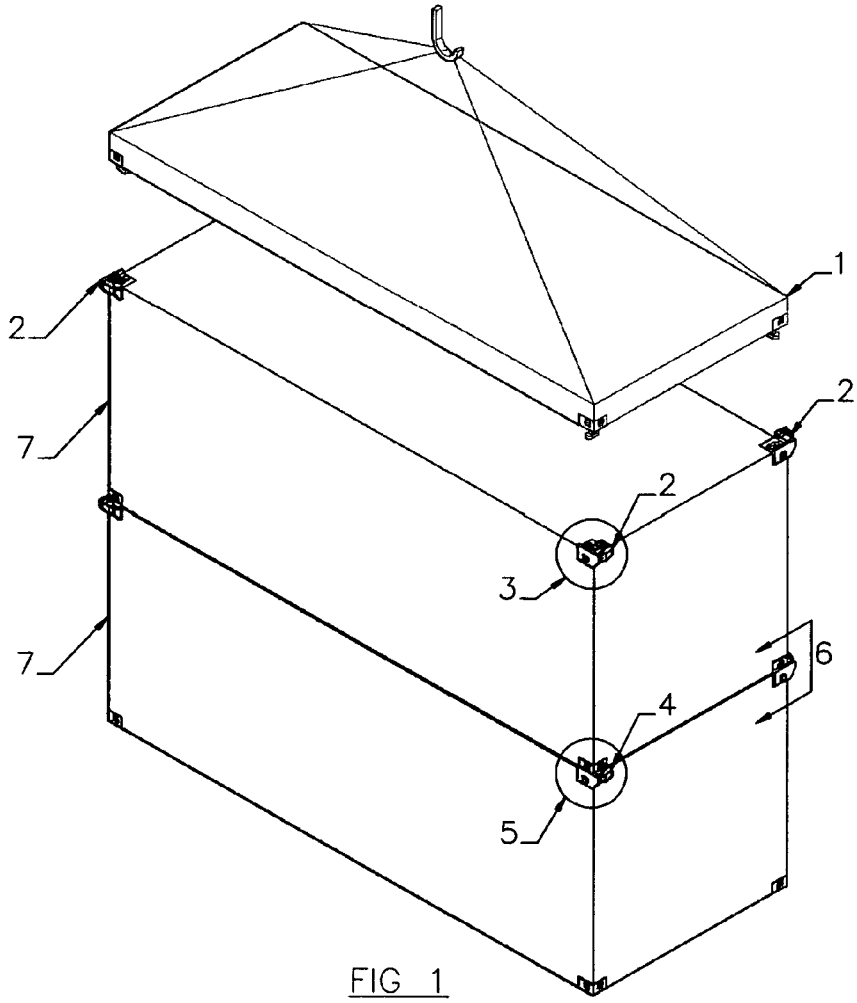
FIG. 1 is a perspective view of two stacked containers connected together, and also showing a lifting crane rig or spreader approaching a position to connect with the corner fittings of the top container.
Figure 2:
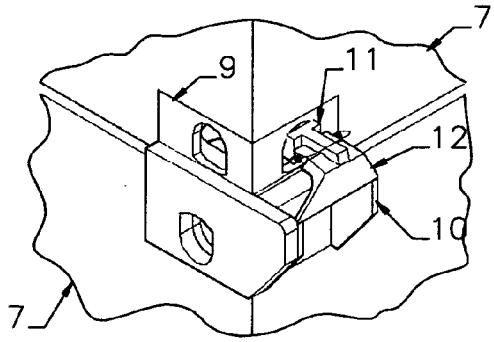
FIG. 2 is an enlarged view in the circle 5 of FIG. 1.

Referring to the drawings, FIG. 1 shows a plurality of containers 7 adapted to be stacked and unstacked by upper automatic locking and unlocking lift corners 2 by a lifting crane rig, or spreader 1. The containers are provided with improved upper world standard corner fittings 2 which also connect to conventional world standard corner fittings 4 as shown in FIG. 2.

Figure 3:
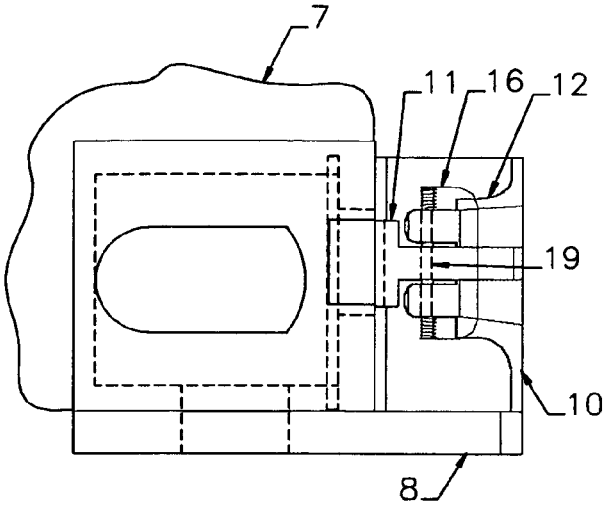
FIG. 3 is an enlarged top view in circle 3 of FIG. 1.
Figure 6:
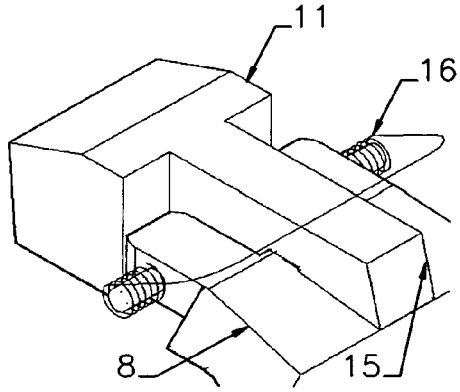
FIG. 6 is an enlarged perspective view in circle 13 of FIG. 4.

Integrated into the upper four corners of the container are the improvements showing the side wall 8 of the improved corner, the back wall of the improved corner 10, the latch arm 12 and the lock/latch 11 in a locked position in the bottom corner of the upper container 9 as shown in FIG. 3. The lock/latch 11 is held in the locked or horizontal position by a spring 16 and pin 19 and prevented from upward movement by 15 impacting the lock/latch arm structure 12 as shown in FIG. 6.

Figure 4:
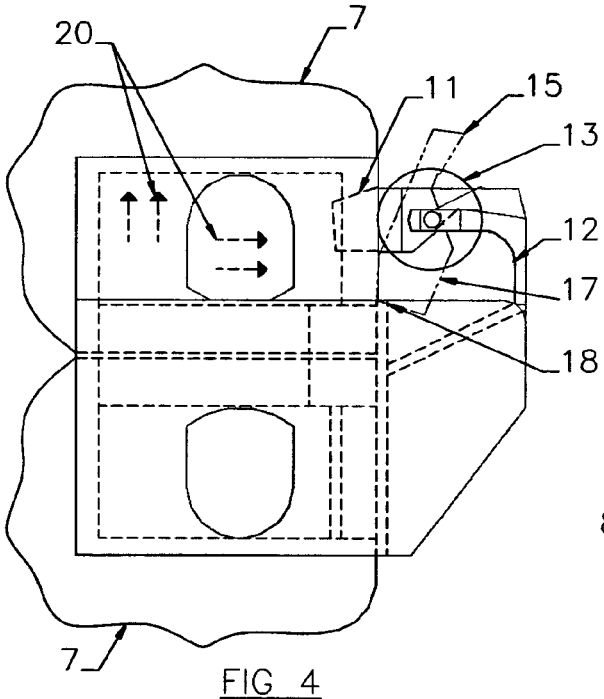
FIG. 4 is an enlarged side view in circle 3 of FIG. 1.
Figure 5:
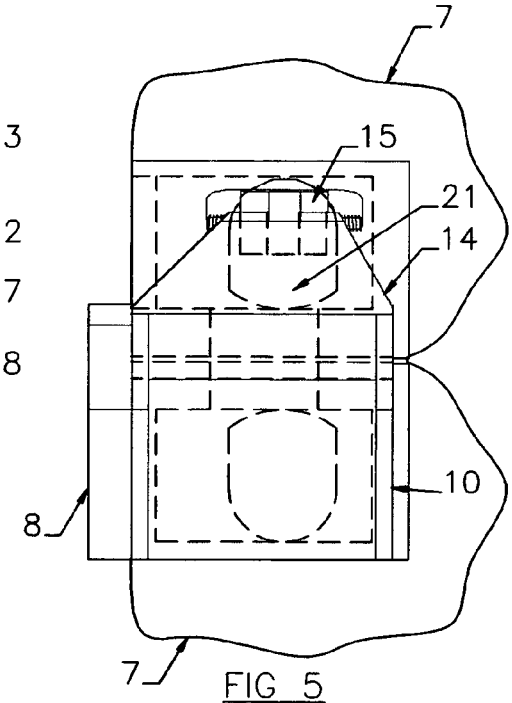
FIG. 5 is a partial enlarged end view taken on line 6-6 of FIG. 1.

The lock shown in FIG. 4 is in locked 11 and unlocked position 17 at point of upper container clearing lip/end stop 18 of 7 and immediately before lock engages upper container bottom end access opening 21. The space to unlock and separate containers 20 is shown in FIG. 5.

To remove top container 7, pick up top of top container 7 with lift rig or spreader 1 and clear lip/end stop 18 of device 2 and maneuver container 7 slightly to the right or left then lift opposite side up to clear lock/latch 11. Now move and container 7 in the opposite direction to clear opposite side lock/latch 11 and remove upper container 7. The space 20 above and behind the lip/end stop 18 of device 2 allows lift rig or spreader 1 enough clearance for this procedure.

It is thus seen that the invention provides simple, economical and efficient means to stack cargo containers for shipping by road, rail or water as well as increased stability during storage and improved fittings and lift means therefore.

What is claimed here is:

1. A cargo container corner fitting assembly to stack and secure a first cargo container over a second cargo container, each cargo container having a top and a bottom surface and longitudinal and lateral sides so as to define top and bottom corners; the assembly comprises: a keeper located at each bottom corner of the cargo containers, each keeper is comprised of a keeper body defining a receiving chamber that is accessible through an opening on the keeper body; and a latch assembly located at each top corner of the cargo containers, each assembly comprising: a latch base; a latch structure having a first end connected to the latch base and a second opposite end; a latch arm pivotally connected to the second end of the latch structure, the latch arm being moved between an extended position and a non-extended position: and a spring member for biasing the latch arm toward the extended position; the latch arms of one lateral side are oriented so as to face the latch arms of the other lateral side; wherein, when the first cargo container is moved toward the top surface of the second cargo container, the keeper body of the first cargo container is adapted to push the latch arm toward the non-extended position, until the latch arm is aligned with the opening of the keeper body, wherein the spring is free to bias the latch arm toward the extended position, and be received within the chamber of the keeper, securing the first and second cargo containers; wherein, in order to detach the first cargo container from the second cargo container, the first cargo container is slightly moved in a right of left direction, so that one of the lateral side latch arms will clear the opening of the respective keeper, allowing the first cargo container to be slightly tilted and moved in the opposite direction so that the other lateral side latch could clear the opening of the keeper.

* * * * *